United States Patent [19]

Norman et al.

[11] Patent Number: 4,776,354

[45] Date of Patent: Oct. 11, 1988

[54] FILTERED SMOKING ARTICLE

[75] Inventors: Alan B. Norman, Clemmons; Thomas A. Perfetti, Winston-Salem; Michael F. Dube, Pfafftown, all of N.C.

[73] Assignee: R. J. Reynolds Tobacco Company, Winston-Salem, N.C.

[21] Appl. No.: 231

[22] Filed: Jan. 2, 1987

[51] Int. Cl.[4] ..... A24D 3/02; A24D 3/04

[52] U.S. Cl. ..... 131/336; 131/365; 131/362; 131/361

[58] Field of Search ..... 131/336, 365, 361, 362

[56] References Cited

U.S. PATENT DOCUMENTS

| | | |
|---|---|---|
| 2,836,183 | 5/1958 | Fay et al. . |
| 3,368,566 | 2/1968 | Avedikian . |
| 3,913,590 | 10/1975 | Sway . |
| 4,146,040 | 3/1979 | Cohn . |
| 4,570,650 | 2/1986 | Sirota . |

*Primary Examiner*—V. Millin

*Attorney, Agent, or Firm*—Stephen M. Bodenheimer, Jr.

[57] ABSTRACT

In one aspect, the invention provides a simple, readily manufacturable, low tar cigarette with individual puff deliveries similar to those obtained from conventional cigarettes which have a higher total smoke delivery such as a full flavor cigarette. The low tar cigarette includes a tobacco rod segment having a length of 53 mm. or less abutting a filter segment having an overall length of at least 31 mm. wherein the filter segment includes a synthetic fiber filter plug and provides a smoke delivery reduction of at least 55% and wherein the cigarette has an average puff count of 6.5 or less. In another aspect, the invention provides nonconventional smoking articles which have an elongated nonsmokable mouthend portion, i.e., greater than ⅜ of the length of the smoking article, yet have the appearance of conventional filtered or non-filtered cigarette wherein the elongated nonsmokable mouthend portion is wrapped with a tipping paper which bears on at least a portion of its surface adjacent its edge nearest the lighting end of the cigarette, a verge pattern visually similar to the verge pattern on a conventional cigarette paper.

21 Claims, 3 Drawing Sheets

FILTERED SMOKING ARTICLE

BACKGROUND OF THE INVENTION

The invention relates to cigarette-type filtered smoking articles and to tipping papers therefor.

In the past 30 years, cigarettes have evolved towards lower tar and nicotine. Initially, the unfiltered cigarette was modified by adding relatively short filters composed of synthetic fibers, typically cellulose acetate, to aid in the removal of particulate matter from mainstream smoke. Later, further reductions in particulate and nicotine yields became desirable. This end was accomplished by increasing length and efficiency of the filters used and by incorporation of moderate to high levels of ventilation in the filter systems of low tar delivery cigarettes. The use of high efficiency filters and filter ventilation reduced the total yield of nicotine and particulate matter on a per cigarette basis as well as the yields of individual cigarette puffs. Thus, conventional low tar cigarettes have not only a reduced strength, but also have reduced taste properties relative to their higher delivery counterparts.

Various cigarette modifications have been proposed to reduce tar and nicotine delivery. For example, U.S. Pat. No. 2,836,183, to Fay et al discloses filtered smoking articles including a warning indicia operatively associated with a point on the tobacco rod at about its midpoint. This warning indicia is intended to encourage the smoker to discontinue smoking the cigarette past about the midpoint of the tobacco rod.

U.S. Pat. No. 3,368,566 discloses a filtered cigarette having a composite filter which includes a plurality of short filters which mechanically and chemically remove and alter various components of cigarette smoke. The series of short filters may be replaced by a single filter having a plurality of zones bearing some sequential resemblance to the mechanical and chemical acting short filter elements.

U.S. Pat. No. 3,913,590 to Sway discloses a multi-sectioned cigarette including a tobacco rod segment at the lighting end of the cigarette which generally comprises from about one-half to about two-thirds of the entire length of the cigarette. Adjacent the tobacco rod is an inert, non-combustible, porous and generally inorganic element capable of extinguishing the fire cone of the cigarette. Downstream of the inert element, there is a second tobacco filler intended to add flavor to the filtered smoke from the burning end of the cigarette.

U.S. Pat. No. 4,570,650 to Sirota discloses a self-extinguishing cigarette comprising a tubular coating around the periphery of the part of the tobacco rod located closest to the filter of the cigarette. The burning tobacco self-extinguishes upon reaching the tubular coating. Additionally, the coating is intended to prevent a smoker from smoking the rear one-third to one-fourth of the tobacco rod.

Although some of the above proposals could potentially reduce the normal puff count of a conventional cigarette, they suffer from various drawbacks including cost, difficulty in manufacture, poor taste, unusual appearance and the like.

U.S. Pat. No. 4,146,040 to Cohn discloses a fire resistant cigarette including a coating on the cigarette paper which decreases burn rate of the tobacco rod. This patent proposes a cigarette with an elongated filter section and a shortened tobacco rod section wrapped with the coated paper. Because of the slower burn rate, the short tobacco rod can have the same amount of puffs as a conventional cigarette. As with the conventional low tar product, the taste and strength of the cigarette on an individual puff basis would be thereby reduced.

Additionally, certain commercially available ultra low tar, and yet lower tar, products having normal filter and tobacco rod lengths, exhibit lower than normal puff counts, of 6 to 6.5 due to tobacco blends having large amounts, greater than 50%, of puffed tobacco with or without cigarette papers of increased porosity. Because of the large amounts of puffed tobacco and/or paper modifications, such products have taste properties different from the full flavor tobacco blend.

SUMMARY OF THE INVENTION

In one aspect, this invention provides in a simple, readily manufacturable and effective form, cigarettes with reduced total smoke yields but with individual puff deliveries similar to those obtained from products having higher total smoke deliveries. The low tar cigarette of the invention comprises a tobacco rod segment abutting a filter segment. The filter segment consists essentially of synthetic fibers, such as cellulose acetate, and effects a wet total particulate matter (WTPM) smoke delivery reduction, based on the unfiltered tobacco rod, of at least 55%. The filter segment has an overall length of at least 31 mm. The tobacco rod has a length of 53 mm. or less. The low tar cigarette has an average puff count of less than 6.5 puffs per cigarette. Advantageously, the puff count is between about 4.5 and about 6.5. In essence, the invention provides a low tar cigarette wherein delivery reduction is achieved by reduction of puff count. By careful selection of tobacco rod length and filter design, the invention can provide a low tar cigarette having 5–6 puffs which are substantially equivalent to the first 5–6 puffs of a full flavor conventional cigarette having an 8-puff average. Similarly, ultra-low tar products can be provided having 5–6 puffs which are substantially equivalent to the first puffs of a conventional low tar cigarette having an average of 7–8 puffs. Low tar cigarettes of the invention can be made using full flavor tobacco blends, thus the taste of individual puffs are improved. Advantageously, the delivery reduction effected by the filter segment, is accomplished with minimal ventilation, thus minimizing the dilution of the smoke.

In another aspect, the invention provides non-conventional smoking articles which have an elongated non-smokable mouthend portion, such as the above, yet have the appearance of a conventional filtered or non-filtered cigarette. In this aspect of the invention, cigarette type smoking articles are provided having a non-smokable segment extending from the mouthend at least about ⅜ of the length of the smoking article. An air impermeable tipping paper surrounds the nonsmokable segment and at least a portion of an abutting second segment of the smoking article. The tipping paper's surface on at least the portion adjacent the edge nearest the lighting end of the smoking article bears a pattern visually similar to conventional cigarette paper comprising a series of verge lines, i.e., gray circumferential lines, on a substantially white background. The portion of the tipping paper nearest the mouthend of the cigarette can bear a conventional cork pattern, other conventional filter tipping patterns or can be verge patterned. Thus, from a distance of a few feet or more, the smoking article appears to be a conventional cigarette having a conventional tobacco rod, 57 mm. or longer. The opacity or white background of the verge portion of the tipping paper can be made slightly different so that it is apparent to a smoker when the cigarette's firecone is approaching the tipping paper.

BRIEF DESCRIPTION OF THE DRAWINGS

In the drawings which form a portion of the original disclosure.

DETAILED DESCRIPTION OF THE PREFERRED EMBODIMENTS

Figure 1:
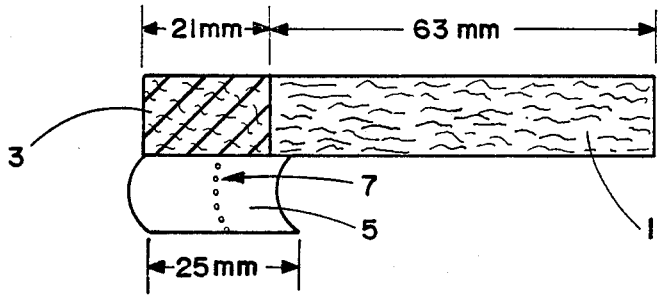
FIG. 1 PRIOR ART
FIGS. 1 and 2 are diagrammatic cross-sectional views of conventional full flavor and low tar filtered king-size cigarettes and illustrate the construction thereof.

FIG. 1 illustrates a conventional full-flavor filter cigarette. Tobacco rod 1 is surrounded by a cigarette paper, not shown, and abuts cellulose acetate filter 3 which is conventionally wrapped with a plug wrap, not shown. Tipping paper 5 is an air impermeable paper which joins filter 3 to tobacco rod 1 Ventilation holes 7 provide air dilution during smoking and contribute to the overall filtration efficiency of the filter. As shown, in a conventional full-flavor filtered cigarette, the filter section generally has a length of about 21 mm. whereas the tobacco rod generally has a length of about 63 mm. The tipping paper generally surrounds the rear 25 mm. of the smoking article so that it surrounds the entire fibrous filter plug and the 4 mm. of the tobacco rod abutting the filter.

Figure 2:
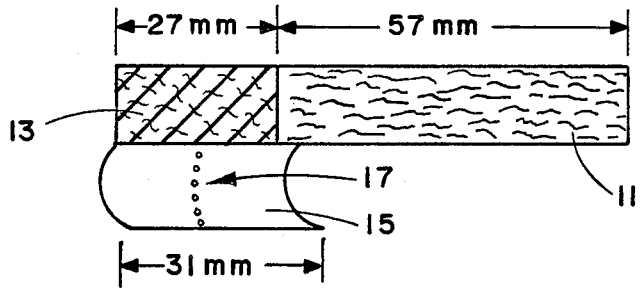
FIG. 2 PRIOR ART

Similarly, FIG. 2 illustrates a conventional low tar cigarette comprising tobacco rod 11, filter plug 13, and tipping paper 15 which normally contains air ventilation holes 17. As illustrated, conventional low tar cigarettes generally have a tobacco rod length of about 57 mm. and a filter plug length of about 27 mm. The tipping paper is generally about 31 mm. so that it extends over both the filter plug and the rear 4 mm. of the tobacco rod.

The conventional cigarettes shown in FIGS. 1 and 2 have a conventional length of about 84 mm. It will be recognized that the so-called "long" cigarettes which typically have a length of about 100 mm., will generally have in the case of full flavor longs, a tobacco rod and a filter plug length of 72 mm. and 27.5, respectively; and tobacco rod and plug lengths of 68 mm. and 31 mm. for low tar versions thereof.

Figure 3:
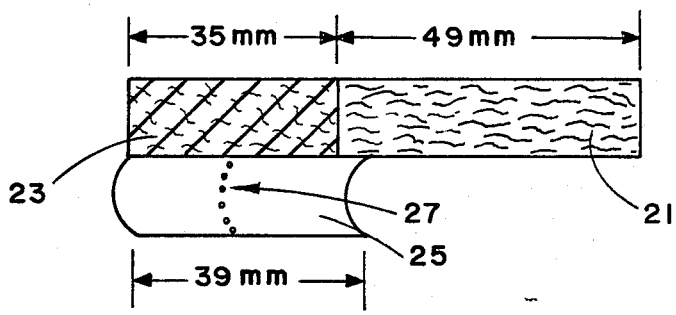
FIG. 3 is a cross-sectional view of a low tar cigarette of the invention.

FIG. 3 is a cross-sectional view of an embodiment of the low tar cigarettes of the invention. Tobacco rod 21 has a reduced length of 49 mm. and is surrounded by a conventional cigarette paper, not shown. Filter plug 23 consists essentially of synthetic fibrous filter media such as polyolefin or cellulose acetate fibers. Tipping paper 25 surrounds filter plug 23 and joins it to tobacco rod 21. Ventilation holes 27 are provided for air dilution of the smoke.

The delivery reduction of the filter segment of the smoking article shown in FIG. 3 is the net result of the filtration characteristics of the synthetic fibrous material making up the filter plug, together with the permeability of the plug wrap (not shown) surrounding the filter plug and the ventilation characteristics of air holes 27. For the purposes of this invention, delivery reduction is determined by the following formula:

DELIVERY REDUCTION =

$$\left[1-\left(\frac{\textit{WTPM}\text{ OF FILTERED CIGARETTE}}{\textit{WTPM}\text{ OF TOBACCO ROD}}\right)\right]\times 100$$

wherein WTPM deliveries are determined according to the standard FTC smoking conditions. The delivery of the tobacco rod can be determined by substituting a hollow tube for the filter segment of the cigarette and attaching the hollow tube to the tobacco rod with tipping paper in the same manner as the filter is attached. Standard FTC smoking procedures are well known in the art and involve 35 ml. puffs of two seconds duration taken one per minute until the firecone reaches a point 3 mm from the edge of the tipping paper nearest the lighting end of the cigarette. When the filter efficiency and the air dilution of the filter segment are known, those skilled in the art can accurately estimate the delivery reduction.

The delivery reduction effected by the filter portion of smoking articles of the invention is at least 55%. This maintains the by-puff deliveries of smoking articles of this invention equivalent to or less than the by-puff deliveries of a conventional, full-flavor cigarette. This is necessary even though the overall filtration efficiency of a full-flavored king-sized cigarette provides typically about a 50% delivery reduction. As indicated previously, the low tar cigarettes of the invention preferably have individual puff deliveries which generally match the corresponding first five or six individual puff deliveries of higher delivery, i.e., full-flavor cigarettes. When the tobacco rod length is shortened, the individual puff deliveries of the first puffs of the tobacco rod will increase and delivery reduction must likewise be increased to compensate.

Figure 4:
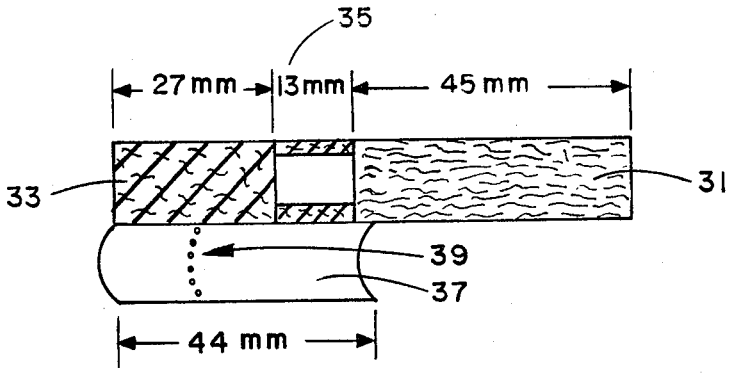
FIG. 4 illustrates in cross-section a low tar cigarette of the invention having another construction.

FIG. 4 illustrates an alternative construction of a low tar cigarette of the invention. Tobacco rod 31 has a length of 45 mm. The filter section of the cigarette is composed of cellulose acetate filter plug 33, hollow cellulose acetate tube 35 and tipping paper 37 which includes air ventilation holes 39. In this case, even though the cellulose acetate filter plug 33 has a length of only 27 mm., it can be composed of a higher efficiency cellulose acetate filter material and/or the degree of ventilation provided by ventilation holes 39 together with plug wrap (not shown) can be increased. Those skilled in the art are capable of modifying filtration efficiency of various cellulose acetate fibrous filter media by varying the total denier and the denier per filament (DPF) thereof.

Generally, low tar (including ultra low tar) smoking articles of the invention are provided having a tobacco rod length which can range from 53 mm. down to a length of about 40 mm. Preferably, the tobacco rod will be sufficiently long to deliver from about 4.5 to about 6.5 puffs per cigarette. Total puff count is determined by smoking a statistically significant number of cigarettes under standard FTC conditions (wherein the smoking process is stpped when the firecone reaches 3 mm. from the tipping). The puff count is generally a function of by the tobacco rod length; however, it will be recognized that other factors which control the burning rate of the tobacco rod such as cigarette paper porosity, percentage of expanded tobacco content in the tobacco rod, density of the tobacco rod, and the like, will also influence the total puff count of the smoking article. Thus, tobacco rod length can be varied within the above-preferred limits to provide smoking articles having puff counts between about 4.5 and about 6.5, preferably 5 to 6. Tobacco blends used in the cigarettes of the invention are preferably blends containing less than 50% by weight puffed tobacco to thereby improve taste. Thus, cigarettes of the invention achieve reduced puff count simply by shortening a conventional tobacco rod length, thereby avoiding the need for modifying extensively, tobacco blends and/or paper porosity which concommitantly modify the taste of the product.

Generally, for a low tar cigarette having 5–6 puffs which are equivalent to the first 5–6 puffs of a full flavored cigarette, delivery reduction accomplished by the filter portion of the cigarette should be between about 55 and about 65%. For an ultra low tar cigarette having a by-puff delivery equivalent to the first 5–6 puffs of a low tar cigarette, a delivery reduction of between about 65% and about 80% is preferred. For cigarettes having a total tar delivery between about 0 and about 3 mg., which have a by-puff delivery similar to the first 5–6 puffs of an ultra low (5–6 mg.) tar product, a delivery reduction of between about 70% and about 90% is preferred.

It is also preferred that ventilation of the filter segment be minimal so that flavor of individual puffs is maximized. In this regard, for cigarettes of the invention which deliver about 8 to about 10 mg. FTC tar, ventilation is preferably 15% or less, most preferably 10% or less; for cigarettes which deliver between about 5 and about 6 mg. FTC tar, ventilation is best maintained at 40% or less, most preferably 30% or less; and for cigarettes which deliver between about 1 and about 3 mg. FTC tar, ventilation is best maintained at 60% or less, preferably 50% or less.

Figure 5:
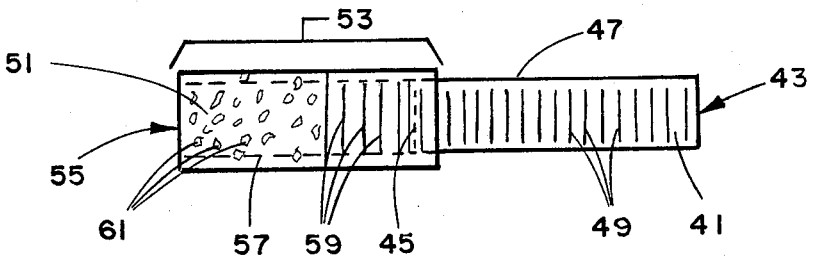
FIG. 5 illustrates a cigarette having an elongated non-smokable rear filter portion wherein the tipping paper which surrounds the filter and joins it to the tobacco rod bears on its exterior surface a pattern of repeating verge lines at one end and a conventional cork pattern at the other end.
Figure 6:
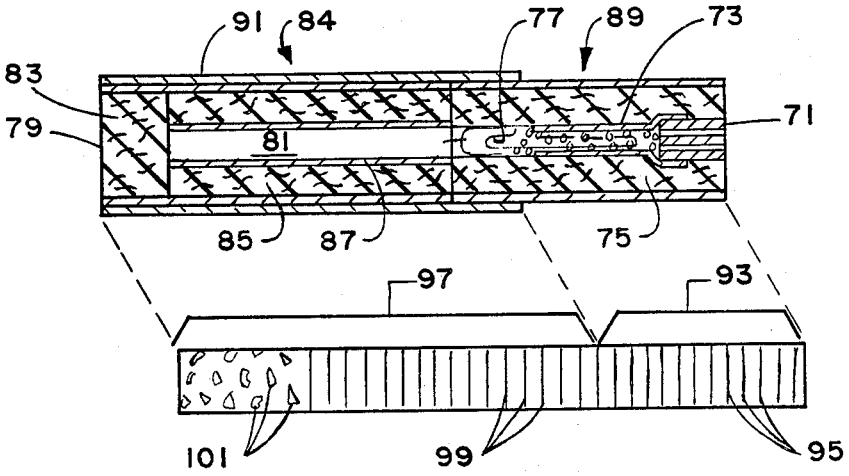
FIG. 6 is a cross-sectional view of a smoking article capable of generating a smoke-like aerosol without the burning of tobacco which comprises a nonsmokable rear section extending over greater than half the length of the smoking article which is surrounded by a tipping paper which also joins the long rear section to the front section of the smoking article wherein the lower portion of FIG. 6 illustrates the visible surface of the tipping paper and the cigarette paper surrounding the front portion of the smoking article.

FIGS. 5 and 6 illustrate nonconventional smoking articles having elongated non-smokable mouthend portions yet have the appearance of a conventional filtered or non-filtered cigarette. FIG. 5 illustrates a low tar cigarette having a short tobacco rod 41 extending from the lighting end 43 thereof to the rear or mouthend of the rod indicated by dotted line 45. Conventional cigarette paper 47 surrounds the periphery of the tobacco rod. The surface of the cigarette paper is white and carries a series of repeating circumferential grey lines 49 which are spaced about 1 mm. apart, generally known in the art as verge lines. A cellulose acetate filter plug 51 is located beneath tipping paper 53 and abuts the rear of tobacco rod 41 and extends from dotted line 45 to the mouthend 55 of the cigarette. Located coaxially between tipping paper 53 and filter plug 51 is plug wrap 57. The tipping paper's surface on the portion thereof adjacent the edge nearest the lighting end of the smoking article bears a pattern visually similar to the pattern on conventional cigarette paper comprising a series of grey circumferential, i.e., verge, lines 59 on a white background. The portion of the air impermeable tipping paper closest the mouthend of the cigarette bears on its exterior surface a beige on brown cork pattern indicated generally at 61. Cork pattern 61, can cover a length of the cigarette preferably from about 24 to about 31 mm., thus corresponding to the length of cork patterns on conventional cigarettes. If desired, cork pattern 61 can be eliminated and verge lines 59 can be extended to the mouthend 55 of the smoking article, thus giving the cigarette the appearance of an unfiltered cigarette. Alternatively, cork pattern 61 can be replaced by any of various conventional filter patterns such as a series of colorful lines or the like.

From a distance of a few feet or more, the low tar cigarette shown in FIG. 5 appears to be a conventional cigarette having a conventional tobacco rod, i.e., having a length of 57 mm. or longer. The visual appearance and acceptability to the consumer is thus improved. In this embodiment, it is preferred that the opacity or white background of the verge portion of the tipping paper be made slightly different than the cigarette paper. The smoker is thus informed when the firecone is approaching the tipping paper and underlying non-smokable portion of the cigarette. It has been found that by slightly varying the opacity or whiteness of the filter paper, that the difference between the tipping paper and the cigarette paper can be made substantially indistinguishable to an average person at 3–5 feet but nevertheless will be readily apparent to the smoker who typically views the cigarette at a distance of 1–2 feet. Where there is substantially no difference between the pattern on the tipping and the cigarette paper pattern, a coating of sodium silicate or the like can be applied to the underside of the tipping edge to extinguish the tobacco rod when the firecone reaches the tipping although this is not a requirement since tipping paper will without modification extinguish the firecone because of its air impermeability.

The tipping paper used in FIGS. 5 and 6 is generally provided as a continuous "double" roll having a width greater than about 68 mm., preferably greater than 74 mm. Those skilled in the art will recognize that cigarettes are conventionally manufactured in the "2-up" process whereby two tobacco rods are joined to each end of a double filter by a tipping paper having a double width, and then the doubled cigarette is converted into two single cigarettes by cutting the double filter rod section transversely across its center. In the double continuous roll form, the tipping paper has two edges with continuous, parallel verge lines. The center pattern can be the same or a different pattern. Where smoking articles are manufactured in a single article process, a continuous roll of single tipping paper can be provided having a width greater than 34, typically greater than 37 mm. and having a pattern adjacent at least one edge with a series of parallel, continuous verge lines.

FIG. 6 illustrates use of the modified tipping paper in combination with other nonconventional smoking articles. In part, FIG. 6 illustrates a cross-sectional view of a smoking article which produces a smoke-like aerosol without the burning of tobacco. A carbonaceous fuel element 71 is in conductive heat exchange relationship with an aerosol generating material contained in metallic capsule 73. A tobacco containing jacket 75 surrounds the metallic capsule and adds tobacco flavors to the aerosol escaping from the capsule via longitudinal holes 77. The aerosol is carried to the mouthend 79 of the smoking article via central passageway 81 and through low efficiency filter 83. The mouthend piece 84 can additionally comprise a fibrous material 85 surrounding a tubing member 87 which defines passageway 81. The exterior of the mouthend piece is joined to the front section of the smoking article 89 by means of tipping paper 91 which encloses the mouthend piece and overlaps a portion of the front section of the smoking article. The exterior appearance of the smoking article is illustrated in the lower portion of FIG. 6. The cigarette paper portion of the smoking article 93 comprises a conventional verge line pattern 95 on a white background. The tipping paper portion of the smoking article 97 comprises a series of repeating verge lines 99 adjacent the lighting end edge of the tipping paper. A beige on brown cork pattern 101 covers the rear or mouthend portion of the tipping paper. Thus, the non-conventional smoking article shown in FIG. 6 appears to be a conventional cigarette. As in the previous embodiments, the cork pattern at the mouthend of the tipping paper can be replaced by verge lines so that the smoking article appears to be an unfiltered cigarette or can be replaced by other tipping patterns.

The following examples serve to illustrate practice of the invention:

EXAMPLE 1

Figure 7:
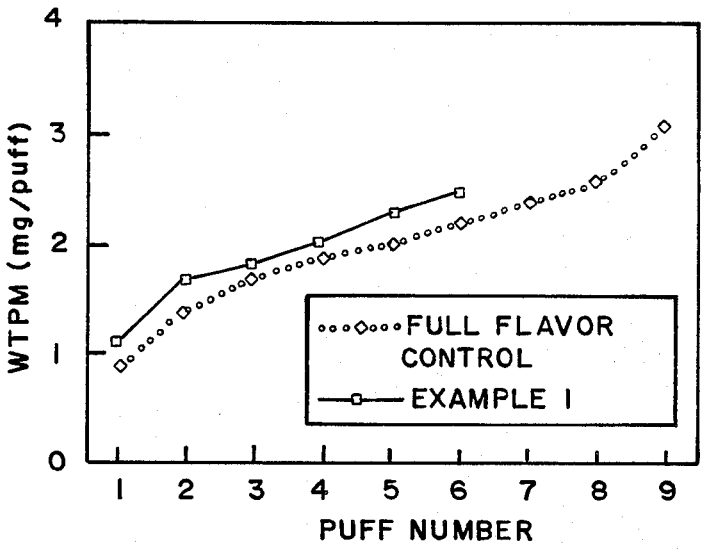
FIG. 7 is a graph comparing the by-puff WTPM deliveries of a conventional full-flavored filtered cigarette and a low tar cigarette of the invention.

A low tar cigarette as generally illustrated in FIG. 3 was prepared wherein the tobacco rod had a length of 48 mm. and the filter plug had a length of 36 mm. The filter plug was prepared from a cellulose acetate tow having a DPF of 4.2 and a total denier of 40,000 by conventional means. No ventilation holes were provided in the filter segment. The cigarette was smoked according to standard FTC conditions and the WTPM for each puff was determined. Additionally, a full flavor cigarette was smoked under standard FTC conditions and the total WTPM per puff was determined. The results are shown in FIG. 7. It can readily be observed that the per-puff delivery for each of the six puffs of the low tar cigarette of this invention substantially matched the first six puffs of a conventional full flavor cigarette. However, when the total WTPM of the conventional full flavor cigarette and the low tar cigarette were calculated, it was found that the full flavor control had a total WTPM of 18.6 mg. whereas the low tar cigarette of the invention had a total WTPM of 11.4 mg.

EXAMPLE 2

Tobacco rods having lengths of 63 mm., 53 mm. and 43 mm. were attached to hollow tubes with tipping in standard fashion with 4 mm. tipping overlap of the tobacco rod. These no filter (hollow-tube) cigarettes were smoked according to standard FTC conditions until the firecone reached 3 mm. from the tipping edge and the WTPM of the products were recorded. In the case of the 63 mm. tobacco rod length, total WTPM deliveries were calculated assuming the presence of a 21 mm. length filter with a 50% WTPM smoke removal efficiency and no air dilution, resulting in a 50% delivery reduction which is generally representative of a conventional full flavored cigarette. Calculations were then made to determine smoke removal efficiencies required (assuming no air dilution) for longer filters to be used with the other shorter length tobacco rods in order to provide low tar cigarettes wherein the by-puff deliveries of the cigarettes matched the corresponding first 6 or 5 puffs of the full flavored product. The results are shown in Table 1, below.

TABLE 1

| | By puff WTPM delivery profiles for tobacco rods of varying lengths. | | | | | |
|---|---|---|---|---|---|---|
| | 63 mm length | | 53 mm length | | 43 mm length | |
| Puff | no filter | 50%[a] removal | no filter | 55%[b] removal | no filter | 65%[c] removal |
| 1 | 2.1 | 1.0 | 1.9 | 0.8 | 2.7 | 0.9 |
| 2 | 2.9 | 1.4 | 3.1 | 1.4 | 4.0 | 1.4 |
| 3 | 3.3 | 1.6 | 3.5 | 1.6 | 4.8 | 1.7 |
| 4 | 3.7 | 1.8 | 4.0 | 1.8 | 6.0 | 2.1 |
| 5 | 4.1 | 2.0 | 4.9 | 2.2 | 7.0 | 2.4 |
| 6 | 4.7 | 2.4 | 5.9 | 2.6 | — | — |
| 7 | 6.0 | 3.0 | — | — | — | — |
| 8 | 7.1 | 3.6 | — | — | — | — |
| total | 33.9 | 16.8 | 23.3 | 10.4 | 24.5 | 8.5 |
| Filter Length Required for 84 mm Cigarette | 21 mm | | 31 mm | | 41 mm | |

[a]Estimated delivery for cigarette with 21 mm filter of 50% removal efficiency.
[b]Estimated delivery for cigarette with 31 mm filter of 55% removal efficiency.
[c]Estimated delivery for cigarette with 41 mm filter of 65% removal efficiency.
Note 1. Estimated delivery = unfiltered delivery × (i-removal efficiency fraction)
Note 2. Under the above assumed conditions of no ventilation in filter segment removal efficiency in percent is equal to delivery reduction in percent.

The results in Table 1 demonstrate that care must be exercised in choosing the filter for the low tar cigarettes of this invention. For example, had a 50% removal efficiency filter been used on all three products, third puff deliveries of the examples shown would be poorly matched, i.e., 1.6 mg., 1.7 mg., and 2.4 mg. for tobacco rod lengths of 63 mm., 53 mm. and 43 mm., respectively. Likewise, simply extending the filter length while using the same filter material for the examples shown above would not achieve the same results. A typical filter for full-flavor application exhibits a 50% WTPM smoke removal efficiency at a length of 21 mm. Extending the length of this filter to 31 mm. or 41 mm. would result in estimated removal efficiencies of about 65% and 75% respectively. Application of this filter in the required lengths would result in by-puff deliveries which do not match the full flavored product.

Additionally, it is to be noted from Table 1 that decreasing tobacco rod length of cigarettes while resulting in reduced total smoke yield and puff count also increases the yield of a particular puff as tobacco rod length decreases. Thus, to provide the desired reduced total yield with by-puff delivery similar to that of higher delivery cigarettes, means for higher delivery reduction must be provided in conjunction with the reduced tobacco rod length.

The invention has been disclosed in considerable detail with reference to various preferred embodiments. However, variations and modifications can be made without departing from the spirit and scope of the invention as described in the foregoing specification and defined in the appended claims.

What is claimed is:

1. A cigarette comprising a tobacco rod segment abutting a filter segment, the filter segment comprising a synthetic fiber filter plug and being adapted to provide a WPTM smoke delivery reduction of at least 50%, said filter segment having an overall length of at least 31 mm.; the tobacco rod having a length of 53 mm. or less and being adapted to provide an average puff count of 6.5 or less.

2. The low tar cigarette defined in claim 1 wherein the tobacco rod length is greater than 40 and the puff count of the low tar cigarette is greater than 4.5.

3. The low tar cigarette defined in claim 2 wherein the overall length of the filter segment is greater than about 34 mm.

4. The low tar cigarette defined in claim 3 wherein the synthetic fibers are cellulose acetate.

5. The low tar cigarette defined in claim 2 wherein the delivery reduction effected by the filter segment is less than 65%.

6. The low tar cigarette defined in claim 5 wherein the filter segment is ventilated sufficient to provide an air dilution of about 10% or less.

7. The low tar cigarette defined in claim 2 wherein the smoke removal efficiency of the filter segment is between 65 and 80%.

8. The low tar cigarette defined in claim 7 wherein the filter segment is ventilated sufficient to provide an air dilution of about 30% or less.

9. The low tar cigarette defined in claim 2 wherein the smoke removal efficiency of the filter section is between 70 and 90%.

10. The low tar cigarette defined in claim 9 wherein the filter segment is ventilated sufficient to provide an air dilution of about 50% or less.

11. A cigarette-type smoking article having a lighting end and a mouthend;

the smoking article having a non-smokable segment extending from the mouthend at least about ⅜ of the length of the smoking article;

an air impermeable tipping paper surrounding the nonsmokable segment and at least a portion of an abutting second segment of the smoking article wherein at least a portion of the exterior surface of the tipping paper adjacent the edge nearest the lighting end of the smoking article bears a pattern visually similar to a conventional cigarette paper comprising a series of grey circumferential lines on a substantially white background.

12. The smoking article defined in claim 11 wherein the portion of the exterior surface of the tipping paper nearest the mouthend of the smoking article bears a pattern visually different from said pattern on a conventional cigarette paper.

13. The smoking article defined in claim 11 wherein the portion of the exterior surface of the tipping paper nearest the mouthend of the smoking article bears said pattern visually similar to a conventional cigarette paper comprising a series of grey circumferential lines on a substantially white background.

14. The smoking article defined in claim 11 wherein the nonsmokable segment of the smoking article comprises a fibrous filter.

15. The smoking article defined in claim 14 wherein the abutting second segment of the smoking article is a tobacco rod.

16. The smoking article defined in claim 15 wherein the white background of the portion of the tipping paper bearing said pattern visually similar to a conventional cigarette paper is visually different from the white background of a conventional cigarette paper.

17. A cigarette tipping paper having a width greater than about 34 mm., the exterior surface of the tipping paper adjacent one edge thereof bearing a pattern visually similar to a conventional cigarette paper comprising a series of parallel grey lines on a substantially white background.

18. The cigarette tipping paper defined in claim 17 wherein said pattern visually similar to a conventional cigarette paper extends across the width of said cigarette tipping paper.

19. The cigarette tipping paper defined in claim 17 wherein a portion of the exterior surface of the tipping paper adjacent the second edge thereof bears a pattern visually different from said pattern similar to a conventional cigarette paper.

20. The cigarette tipping paper defined in claim 17 wherein the cigarette tipping paper has width greater than about 37 mm.

21. The cigarette tipping paper defined in claim 17 provided in the form of a continuous roll having a double width of greater than 68 mm. wherever said pattern similar to a conventional cigarette is located adjacent both edges thereof.

* * * * *

UNITED STATES PATENT AND TRADEMARK OFFICE

CERTIFICATE OF CORRECTION

PATENT NO. : 4,776,354

DATED : October 11, 1988

INVENTOR(S) : Alan B. Norman, Thomas A. Perfetti and Michael F. Dube

It is certified that error appears in the above-identified patent and that said Letters Patent is hereby corrected as shown below:

Column 3, Line 45, should read --which joins filter 3 to tobacco rod 1. Ventilation holes 7--.

Column 5, Line 14, "stpped" should read --stopped--.

Column 8, Line 29, should read --Note 1. Estimated delivery = unfiltered delivery x (1-removal efficiency fraction)--.

Column 9, Line 1, "50%" should read --55%--.

Signed and Sealed this

Fourth Day of April, 1989

*Attest:*

*Attesting Officer*

DONALD J. QUIGG

*Commissioner of Patents and Trademarks*